US007926655B1

(12) United States Patent
Branyon et al.

(10) Patent No.: US 7,926,655 B1
(45) Date of Patent: Apr. 19, 2011

(54) PACKAGING SYSTEM FOR HOLDING STACKED SEEDLING TRAYS

(75) Inventors: Jacob Branyon, Springfield, TN (US); James Lowry, Franklin, TN (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 12/960,922

(22) Filed: Dec. 6, 2010

(51) Int. Cl.
*B65D 85/52* (2006.01)

(52) U.S. Cl. ..... 206/423; 206/593

(58) Field of Classification Search ..... 206/591, 206/593, 594, 499, 423; 47/901
See application file for complete search history.

(56) References Cited

U.S. PATENT DOCUMENTS

| | | | | |
|---|---|---|---|---|
| 2,893,550 | A * | 7/1959 | Sandmeyer | 206/499 |
| 3,379,304 | A | 4/1968 | Mertz | |
| 3,664,062 | A | 5/1972 | Danielson | |
| 3,924,354 | A | 12/1975 | Gregoire | |
| 4,235,338 | A | 11/1980 | Dugan et al. | |
| 4,577,759 | A | 3/1986 | Kreeger | |
| 5,141,149 | A * | 8/1992 | Fulton | 229/103 |
| 5,743,399 | A | 4/1998 | Beckwith | |
| 6,053,346 | A | 4/2000 | Niles et al. | |
| 6,968,947 | B2 * | 11/2005 | Johnson | 206/423 |
| 2007/0045973 | A1 * | 3/2007 | Grosso | 280/47.26 |

* cited by examiner

*Primary Examiner* — Jacob K Ackun, Jr.
(74) *Attorney, Agent, or Firm* — Miller Matthias & Hull LLP

(57) ABSTRACT

A packaging system for seedling trays is provided which maintains the trays in a stacked, spaced apart vertical arrangement. The packaging system comprises an outer box, a tray holder folded into a U-shape and placed inside the box for holding the trays, and a locking device comprising locking panels wedged between the trays.

9 Claims, 10 Drawing Sheets

PACKAGING SYSTEM FOR HOLDING STACKED SEEDLING TRAYS

BACKGROUND OF THE INVENTION

1. Field of the Invention

This invention patent relates to packaging. More particularly, this invention relates to a packaging assembly for holding vertically arranged seedling trays in a fixed spatial relationship to prevent damage to the seedlings.

2. Description of the Related Art

The nursery/flower industry ships a variety of seedlings via small parcel carriers or tray holder boxes. The seedlings are carried in injection molded or thermoformed trays, each tray comprising multiple cells, with each cell typically containing one seedling. The trays are arranged vertically inside the tray holder boxes with up to seven or more trays per box.

In order to avoid damage to the seedlings the trays must be spaced apart vertically and remain that way during shipping and handling. Currently this spacing is accomplished by inserting each tray into a corrugated fold up device that provides headspace above each tray. A problem with this current packaging system is that the corrugated fold up device can collapse during shipping, causing the trays to collapse on each other and damage the seedlings.

Thus there is a need for a packaging assembly for holding vertically arranged trays in a fixed spatial relationship to each other that resists collapsing.

Further and additional objects will appear from the description, accompanying drawings, and appended claims.

BRIEF SUMMARY OF THE INVENTION

The present invention is a packaging system for seedling trays. The system comprises a box, a foldable U-shaped tray holder and a locking device.

The foldable U-shaped tray holder comprises a bottom panel having parallel side edges and two side panels extending upwardly from each side edge. Each side panel comprises vertically spaced apart ledges so that, when the tray holder is folded into a U-shaped structure, it comprises multiple pairs of opposing ledges. The tray holder is inserted into the box with the side panels abutting the box side walls. A plurality of seedling trays is then placed inside the box, with each tray resting on a pair of opposing ledges.

The locking device comprises two halves hingedly connected to each other along a center fold line. Each half comprises a body panel having front and rear edges and multiple, spaced apart locking panels extending from the rear edge. The locking panels of one half are horizontally aligned with and in opposition to the locking panels of the other half, with each pair of opposing locking panels connected along the center fold line. The locking device is folded in half and then placed in the box with the locking panels extending between the trays. Then the body panels are folded away from each along fold lines defined by the rear edges until each body panel abuts the trays. The box is then sealed and ready for shipping.

DETAILED DESCRIPTION OF THE INVENTION

Figure 2:
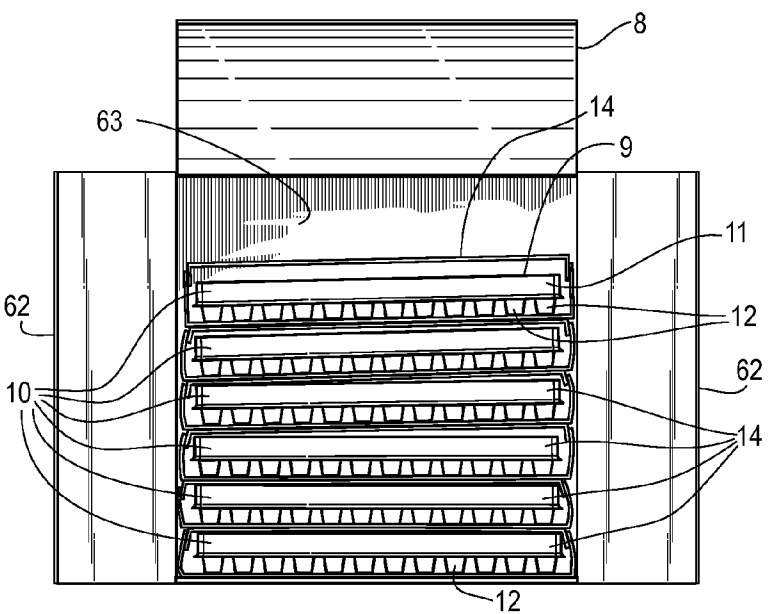
Fig. 2 PRIOR ART
FIG. 2 is a front elevational view of the prior art packaging system of FIG. 1, shown after the corrugated fold up devices have partly collapsed during handling and/or shipping.

While this invention may be embodied in many forms, there is shown in the drawings and will herein be described in detail one or more embodiments, with the understanding that this disclosure is to be considered an exemplification of the principles of the invention and is not intended to limit the invention to the illustrated embodiments.

PRIOR ART

Figure 1:
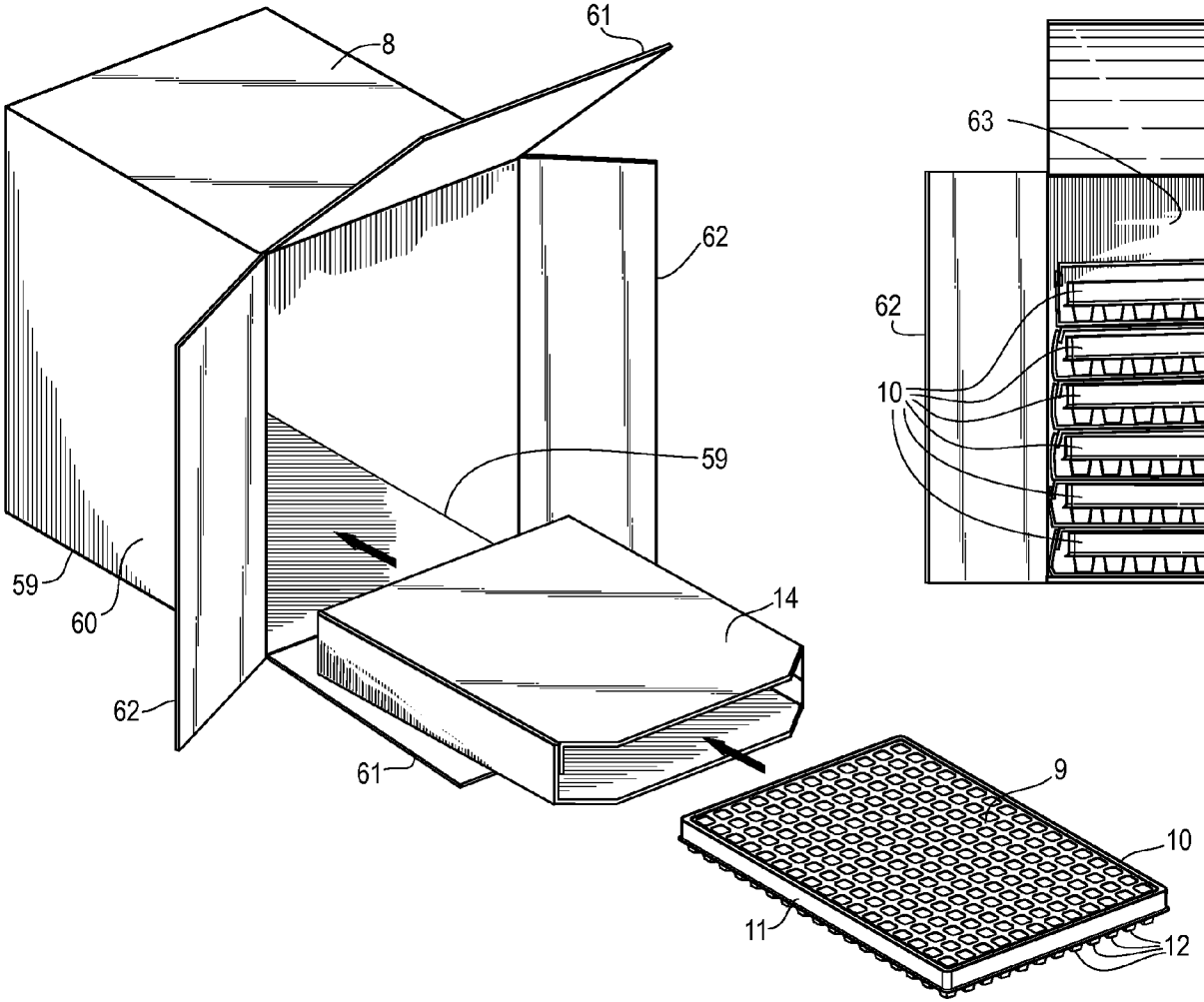
Fig. 1 PRIOR ART
FIG. 1 is perspective view of a prior art packaging system for seedling trays that includes corrugated fold up devices.

The nursery/flower industry ships a variety of seedlings inside small parcel carriers or boxes 8. As shown in FIG. 1 the seedlings are carried in injection molded or thermoformed trays 10. Each tray 10 comprises a substantially flat top surface 9, a side wall 11 extending downward from the periphery of the top surface 9, and multiple individual cup-shaped cells 12 extending downward from the top surface 9. Each cell 12 typically contains one seedling. The trays 10 are arranged vertically inside the box 8 with up to seven trays or more per box 8. The tray side walls 11 each have a vertical thickness measured as the distance from the top surface 9 to the lower edge of the side wall 11.

In order to avoid damage to the seedlings, the trays 10 must be spaced apart vertically. Currently this spacing is accomplished by inserting each tray 10 into a "corrugated fold up" 14 that provides headspace above each tray 10. As shown in FIG. 2, a problem with this packaging system is that the corrugated fold up 14 can collapse during shipping, damaging the seedlings.

The Present Invention

Figure 3:
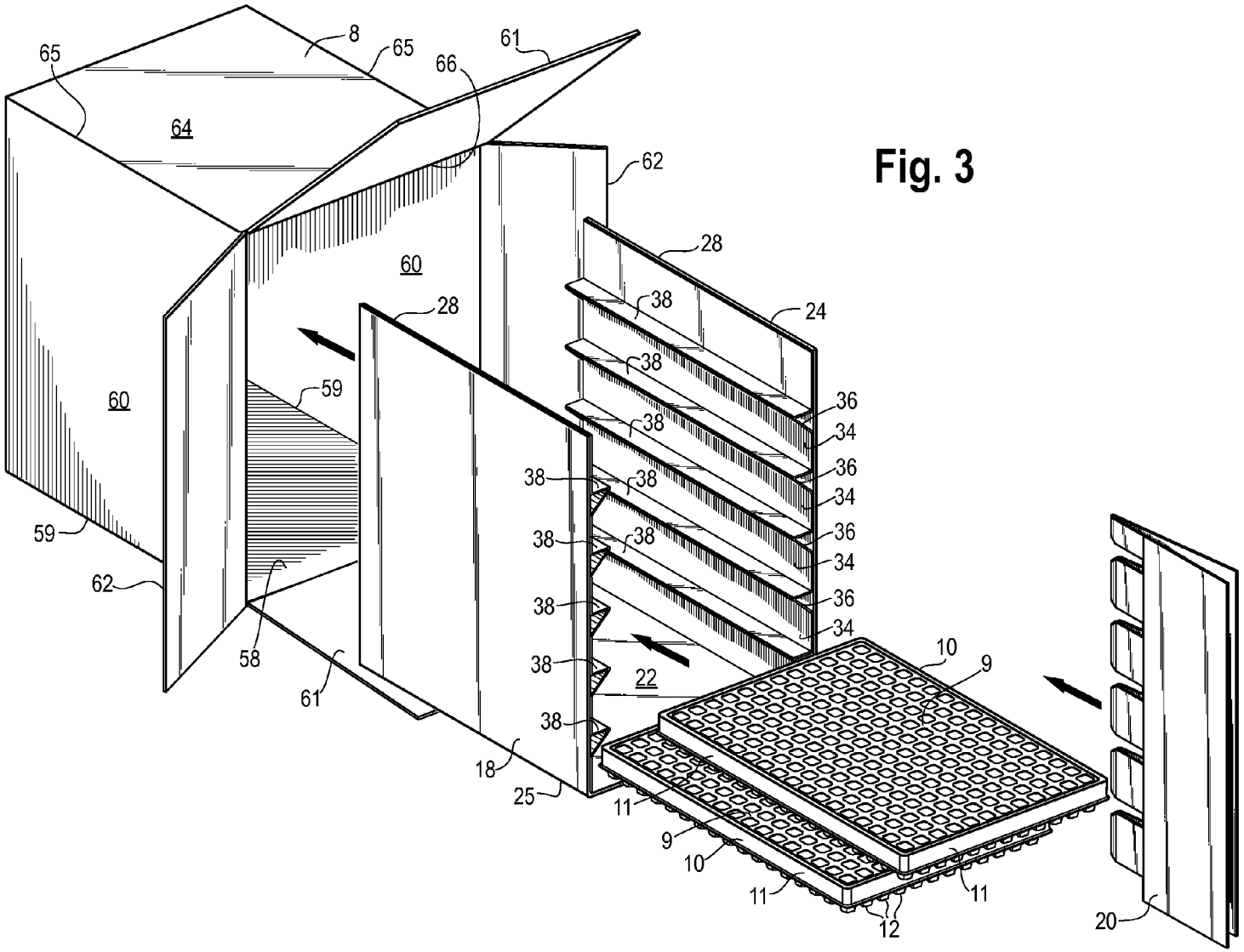
FIG. 3 is an exploded perspective view of a packaging system for seedling trays according to the present invention, including a U-shaped tray holder and a tray locking device.
Figure 5:
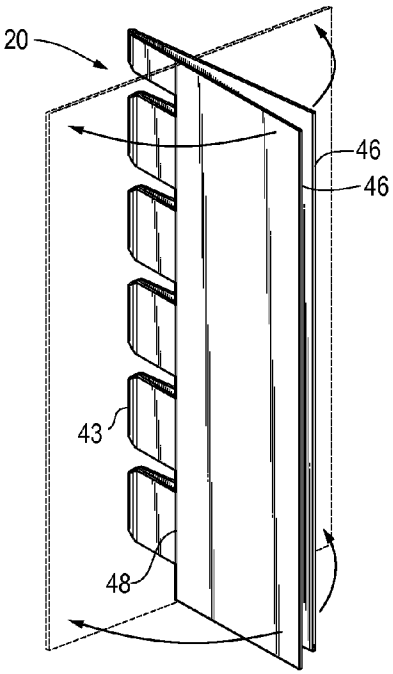
FIG. 5 is a perspective view of the tray locking device of FIG. 3 showing how the locking device is to be folded upon installation.

To solve this problem a new packaging system 16 is provided that comprises a U-shaped tray holder 18 and a locking device 20 as shown in FIG. 3. The tray holder 18 fits inside the box 8 and holds the seedling trays 10 in a vertically spaced apart arrangement. The locking device 20 is a folded structure having tabs 56 that are inserted between the trays to prevent the trays 10 from bouncing up and down during shipping. The tray holder 18 and locking device 20 can be made from either paper based materials or plastic.

The carrier or box 8 typically is a six sided rectilinear structure having a bottom 58, two opposing side walls 60 extending vertically upward from the side edges 59 of the bottom 60, a rear wall 63 extending vertically upward from a rear edge of the bottom 58, a top panel 64 extending from a top edge 65 of one side wall 60 to the top edge 65 of other side wall 60 and having a rear edge affixed to the rear wall 65 and a front edge 66, and closure flaps 61, 62 hingedly connected to the front edges of the bottom 58, top panel and side panels 60.

Tray Holder

Figure 13:
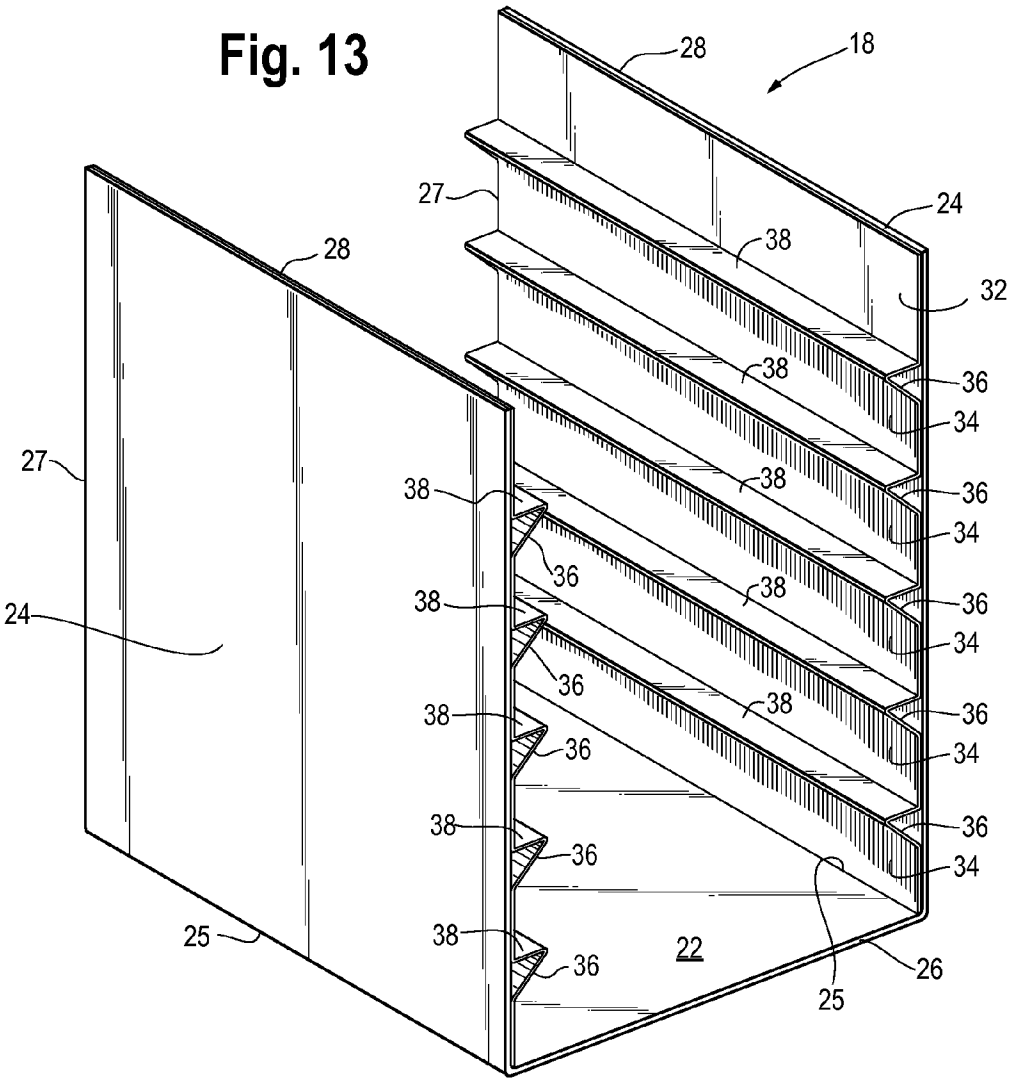
FIG. 13 is a perspective view of the U-shaped tray holder of FIG. 3.

FIGS. 10-13 show various views of the tray holder 18 of FIG. 3. The tray holder 18 may be manufactured and shipped as the flat (unfolded) structure shown in FIGS. 10 and 11, and then folded for use on site as shown in FIG. 13.

Figure 10:
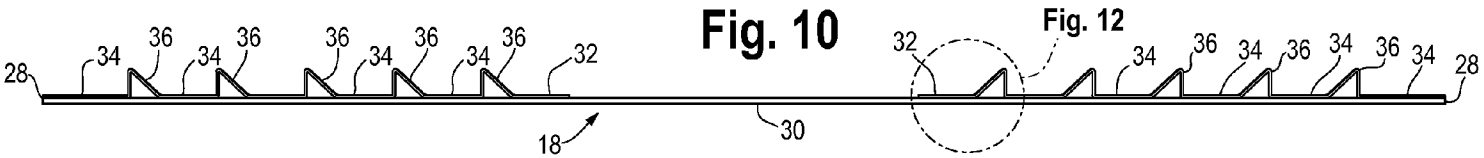
FIG. 10 is a front view of the U-shaped tray holder of FIG. 3 prior to being folded.
Figure 11:
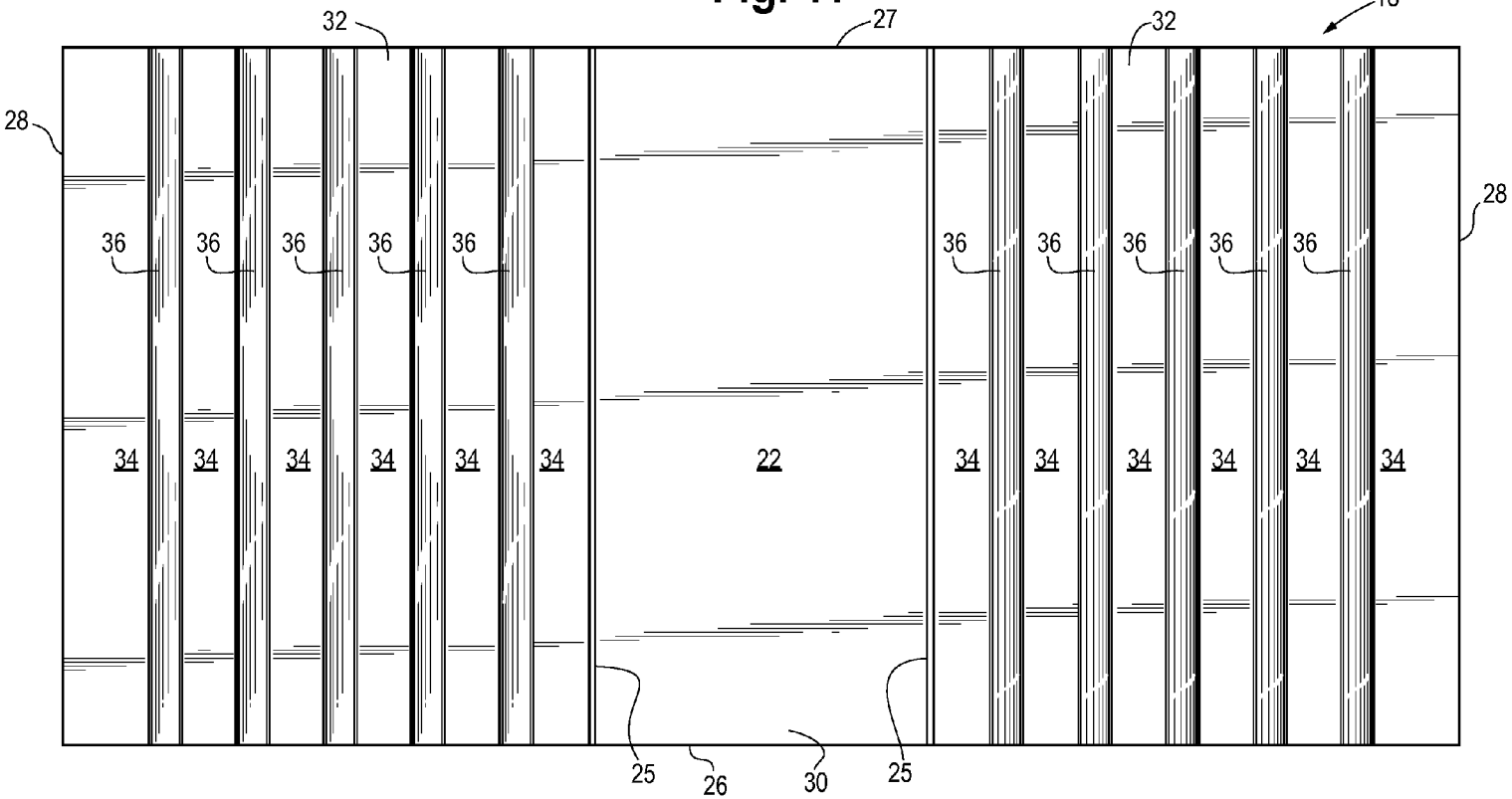
FIG. 11 is a top view the U-shaped tray holder of FIG. 10.

Referring to FIGS. 10 and 11, the tray holder 18 may be manufactured as a substantially planar, substantially rectangular structure comprising a front edge 26, a rear edge 27, and parallel side edges 28. (Edges 28 are referred to as "side edges 28" when referring to the planar, unfolded structure of FIGS. 10 and 11, and as "top edges 28" when referring to the folded U-shaped structure shown in FIG. 3.)

Preferably the tray holder 18 comprises a rectangular backing 30 and two folded members 32 affixed to the backing 30 by glue or other means and spaced from each other by a central area 22. The backing 30 preferably is made of corrugated board, that is, a corrugated paper sheet interposed between two planar paper sheets. Each folded member 32 preferably is made from one or more paper plies and comprises flat (unfolded) areas or portions 34 interposed between integrally formed, spaced apart ledges 36 extending away from the backing 30. The tray holder 18 may also be formed from plastic sheet material or any suitable material. The ledges 36 are elongated and preferably extend from the front edge 26 of the tray holder 18 to the back edge 27, although the ledges 36 need not extend the entire distance between the front and back edges 26, 27.

Figure 12:
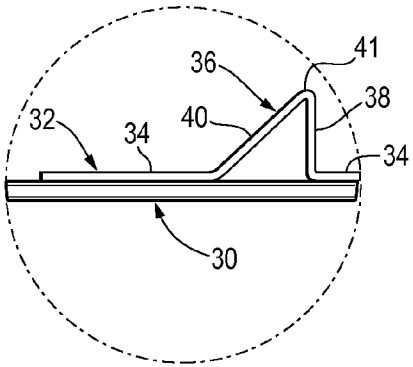
FIG. 12 is a close up view of a part of the U-shaped tray holder of FIG. 10.

As best shown in FIG. 12, each ledge 36 comprises a flat, load supporting panel 38 extending substantially perpendicular from the corrugated backing 30 and terminating in a distal edge 41, and a second, diagonal panel 40 extending diagonally downward from the distal edge 41 to the backing 30. Preferably each set of ledges 36 is formed from a single folded sheet of material, although it is anticipated that one or more ledges 36 on each side of the U-shaped tray holder 18 could be formed from separate sheets of material.

When folded along side edges 25 as shown in FIG. 13 until the side panels 24 are perpendicular to the central area 22, the tray holder 18 becomes substantially U-shaped, with the central area 22 becoming a horizontally oriented bottom panel 22, and the two side panels 24 extending vertically upward from the side edges 25 of the bottom panel 22. The side panels 24 together comprise multiple pairs of opposing ledges 36, with the opposing ledges 36 of each pair extending inward toward each other and being the same height above the bottom panel 22. The load supporting surfaces 38 of the ledges are now horizontal and present flat surfaces on which the trays 10 can be placed.

Preferably, the width (from side panel 24 to side panel 24) of the bottom panel 22 is substantially the same as the width of the box 8 so that, when the tray holder 18 is installed inside the box 8, the side panels 24 abut the box side walls 60. It is also preferable that depth of the bottom panel 22 be substantially the same as the internal depth of the box 8 to prevent movement of the tray holder 18 inside the box 8 and to ensure a good friction fit of the tray holder 18 to the inside of the box 8.

Tray Locking Device

Figure 15:
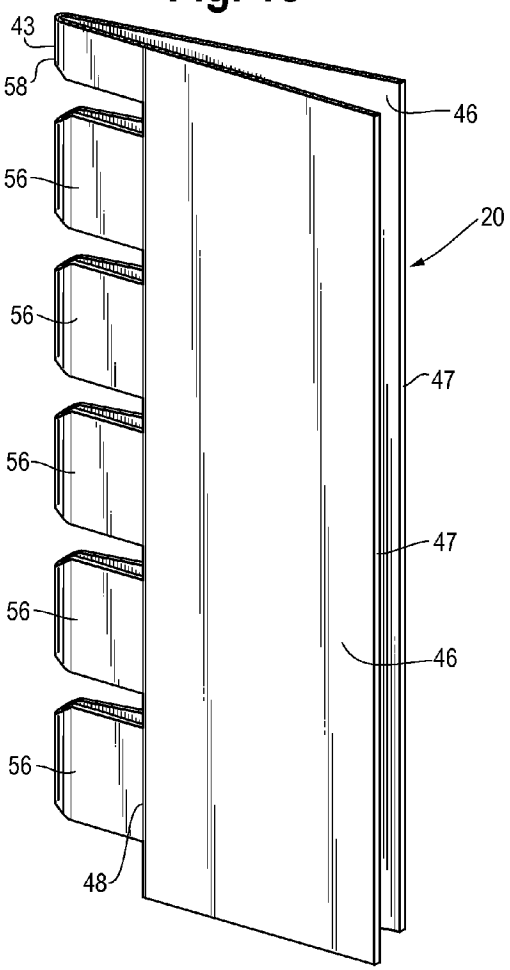
FIG. 15 is a perspective view of the tray locking device of FIG. 14 after being folded along a center fold line.
Figure 14:
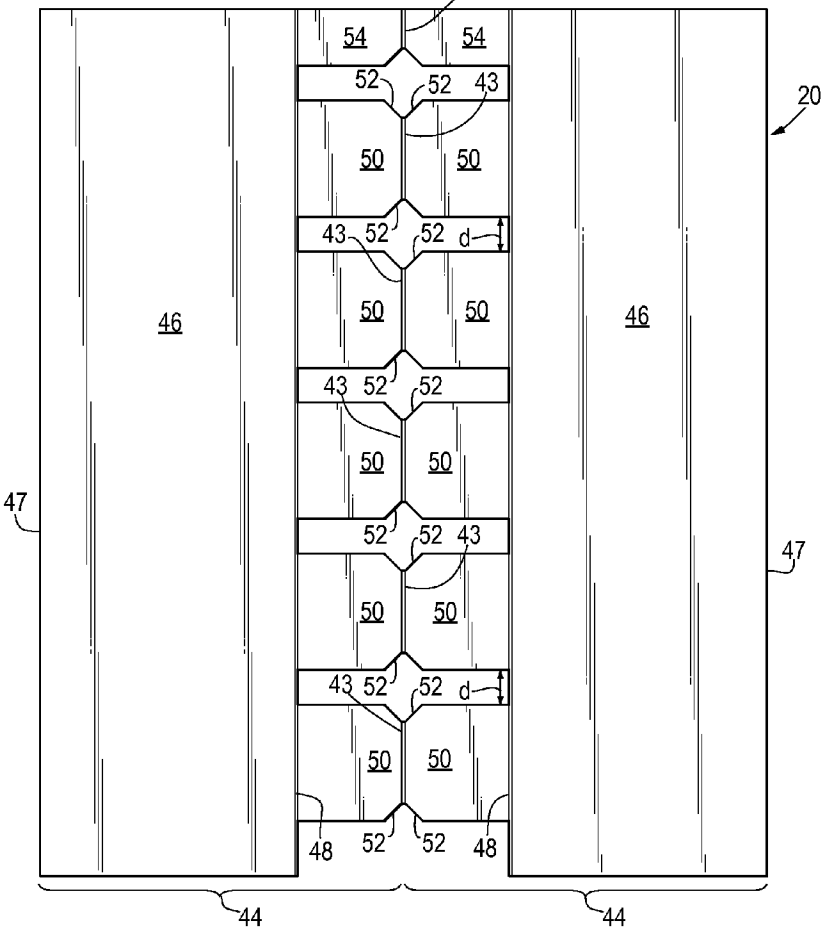
FIG. 14 is a front view the tray locking device of FIG. 3 prior to being folded.

The tray locking device 20 is a folded corrugated structure that prevents the trays 10 from bouncing up and down during shipping. FIGS. 14 and 15 are two views the locking device 20 of FIG. 3 before and after being folded along a center fold line 43. The locking device 20 comprises two mirror image halves 44 hingedly connected to each other along the center fold line 43. Each half 44 comprises a substantially rectangular shaped body panel 46 having front and rear edges 47, 48 and multiple, spaced apart locking panels 50 extending perpendicularly from the rear edge 48 of the body panel 46. Each locking panel 50 of each half 44 is aligned with an opposing locking panel 50 of the other half 44 and connected thereto along the center fold line 43. The locking panels 50 may be any suitable shape that enables them to be inserted between the trays 10, such as the rectangular shape shown in the figures with beveled rear corners 52 to facilitate insertion of the locking device 20 between the trays 10. Each half 44 may also comprise an upper locking panel 54 extending from the rear edge 48 of the body panel 46 above the topmost locking panel 50.

The locking device 20 is foldable along the center line 43 and also along the rear edges 48. When the locking device 20 is folded along the center line 43, each pair of opposing locking panels 50 comes together in substantially facing relationship to form a hinged locking tab 56 and the upper locking panels 54 come together in substantially facing relationship to form a hinged upper locking tab 58 as shown in FIG. 15. The distance (d) (FIG. 14) between each pair of vertically spaced apart locking tabs 56, 58 should be substantially the same or just slightly greater than the height of each tray side wall 11.

Assembly

The packaging system 16 may be assembled and installed in a seedling box 8 as follows. Referring to FIG. 3, the tray holder 18 is folded into a U-shape along the bottom panel side edges 25 and inserted into the box 8. The tray holder 18 can be wedged into the box 8 to form a friction fit, and/or it can be glued to the box side walls 60 and/or bottom 58 of the box 8 if desired.

Figure 4:
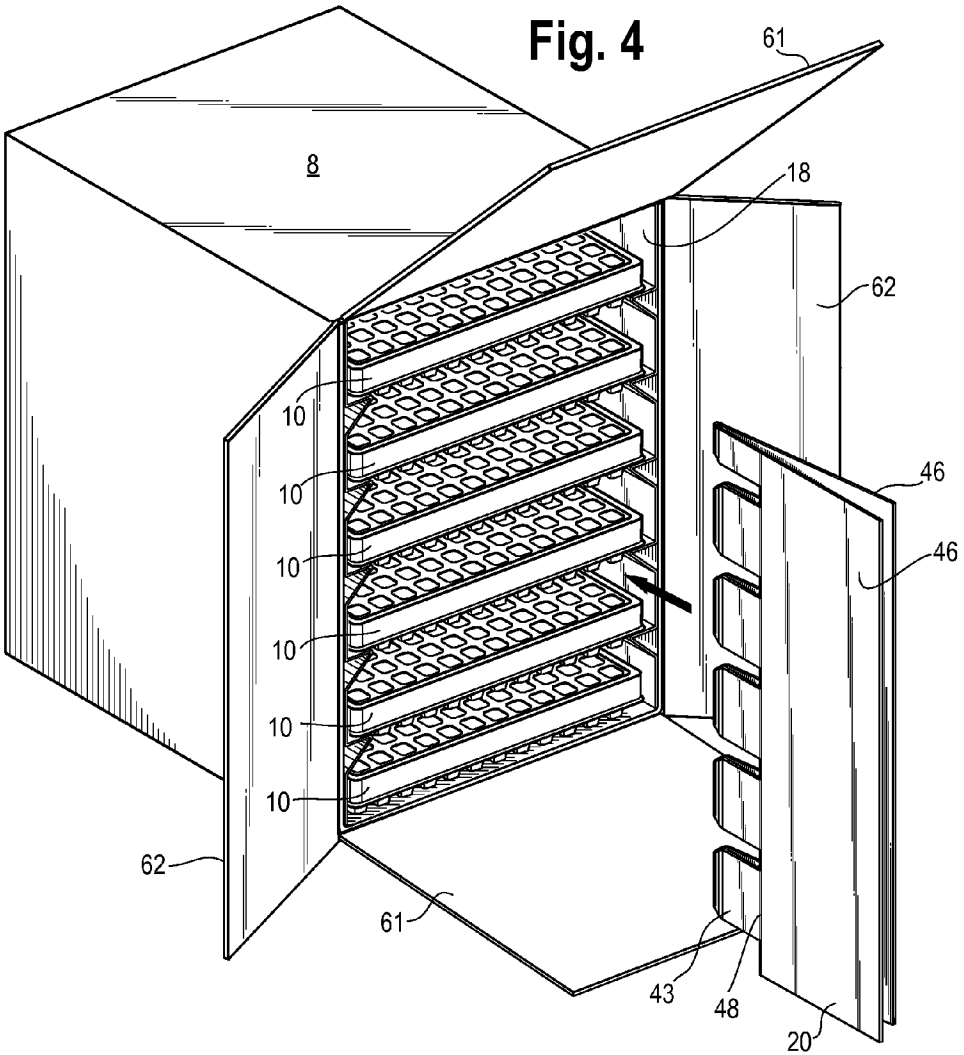
FIG. 4 is a perspective view of the packaging system of FIG. 3 shown partially assembled.

Next, the seedling trays 10 are placed in the box 8 so that the side wall 11 of each tray 10 rests on a pair of opposing ledges 36 and, more particularly, on the load supporting panels 38 of the opposing ledges 36. The width of the trays 10 preferably is substantially the same as the distance between the flat portions 34 of each side panel 24. FIG. 4 is a perspective view of the packaging system of FIG. 3 shown with the tray holder 18 installed and multiple trays 10 resting on the tray holder ledges 36.

Figure 7:
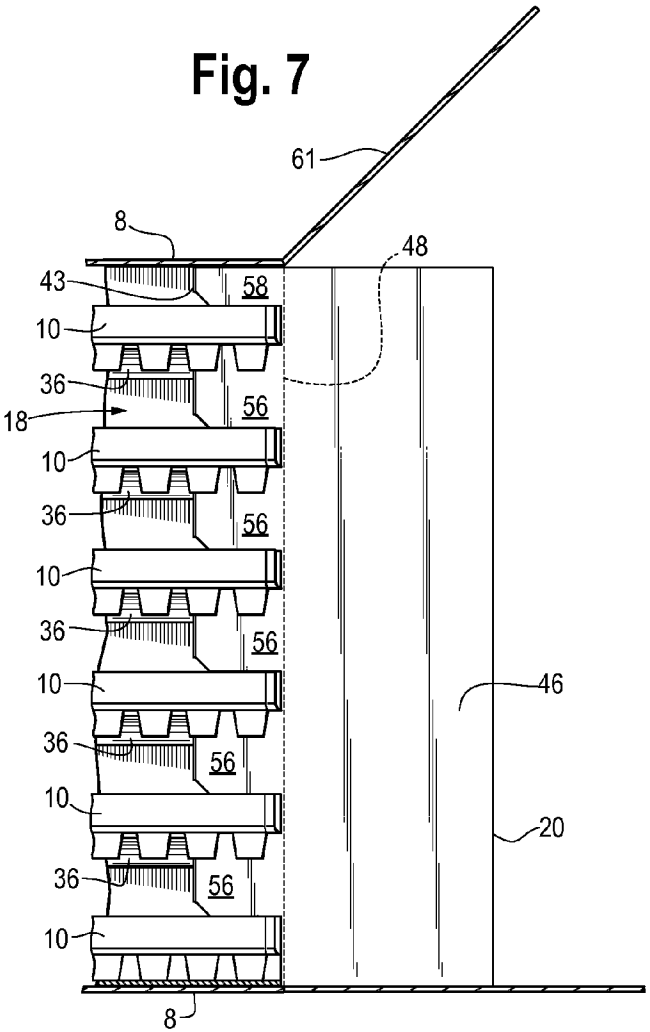
FIG. 7 is a cross sectional view of the packaging system of FIG. 6 taken along line 7-7.

Next, the tray locking device 20 of FIG. 14 is folded along fold line 43 so that it assumes the narrow V-shape shown in FIGS. 4 and 15. Then the locking device 20 is inserted into the box 8 until the locking tabs 56 extend as far as possible between the trays 10. Preferably the locking device 20 is inserted until the rear edges 48 of each body panel 46 abut the front edges of each tray 10 as best shown in FIG. 7.

Figure 6:
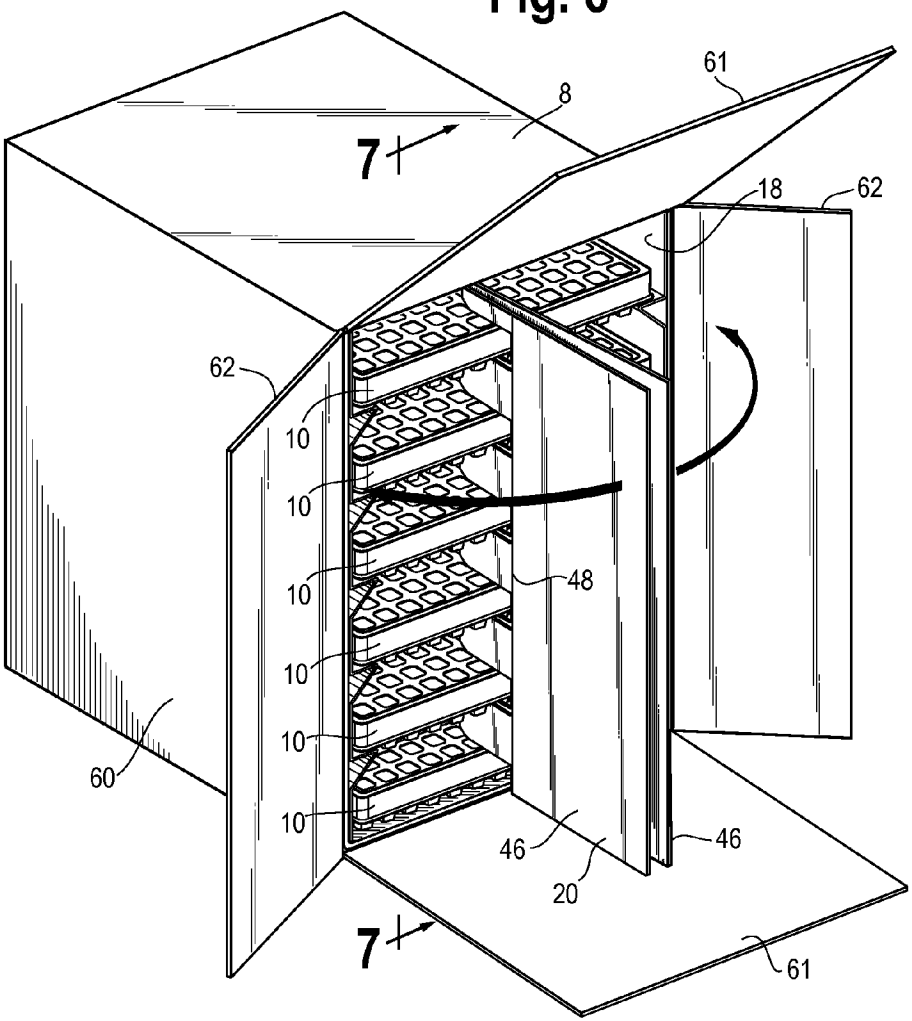
FIG. 6 is a perspective view of the packaging system of FIG. 4 after the tray locking device has been inserted between the trays.
Figure 8:
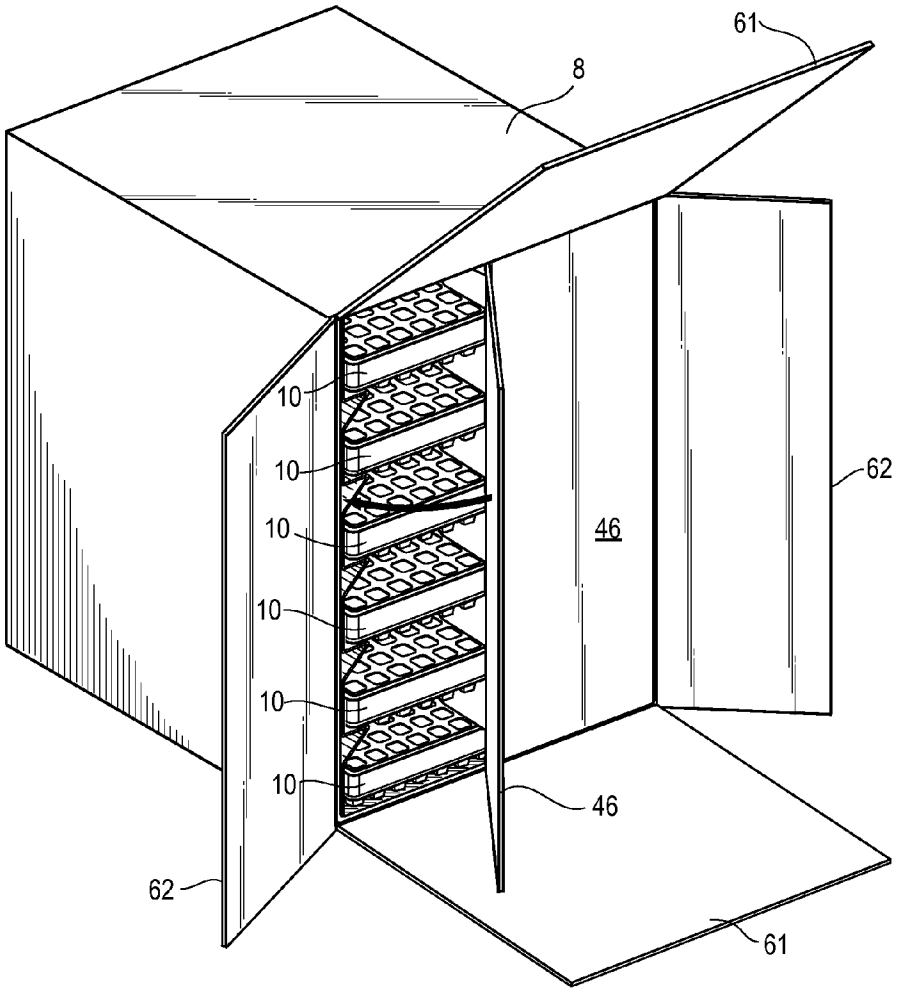
FIG. 8 is a perspective view of the tray locking device of FIG. 6 showing the locking device almost completely installed.

Next, as shown in FIGS. 6 and 8, the locking device body panels 46 are folded away from each other along rear edges/fold lines 48 until the body panels are aligned in a plane and the major surfaces of the body panels 46 abut the trays 10 in facing relationship therewith. FIG. 8 shows the locking device 20 with just the right side body panel 46 abutting the trays 10.

Figure 9:
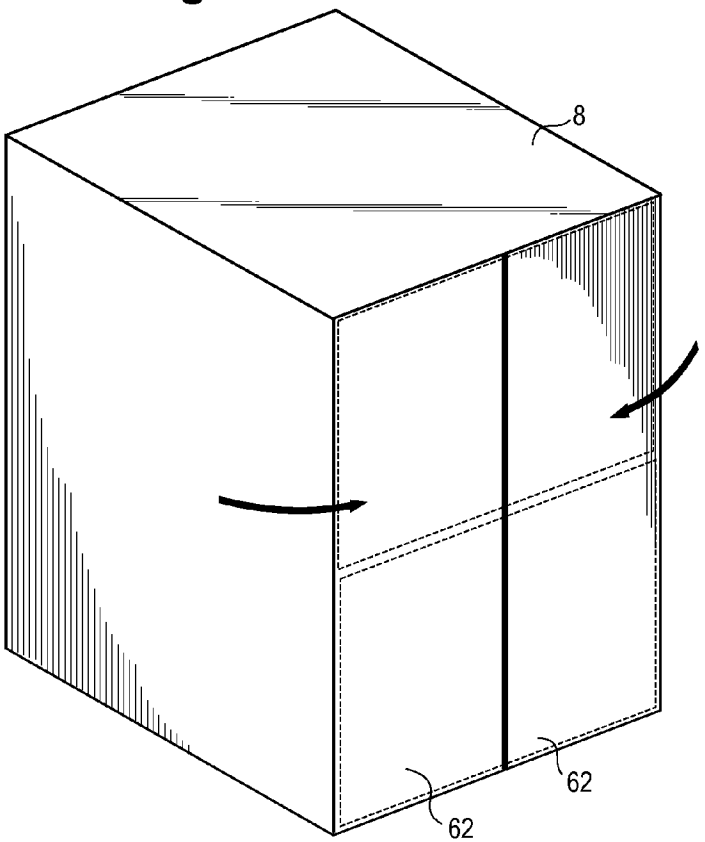
FIG. 9 is a perspective view of the packaging system of FIG. 8 shown completely assembled.

Finally, the seedling box closure flaps 61, 62 are folded together to complete the assembly as shown in FIG. 9. The closure flaps 61, 62 may be taped, glued or otherwise secured shut.

Tray Holder Alternative Embodiment

Figure 17:
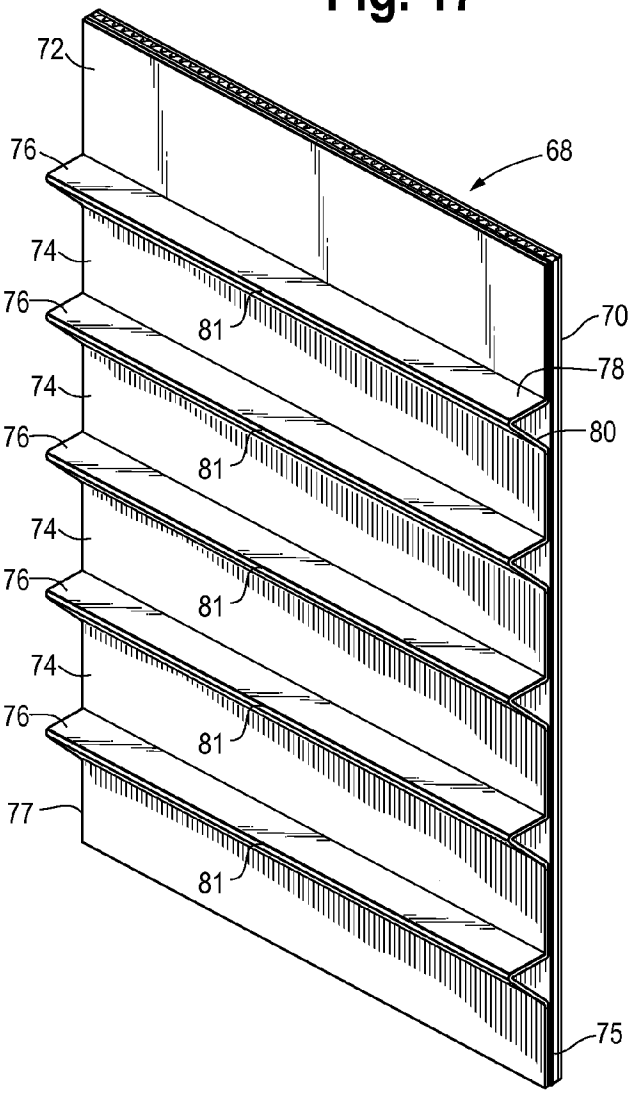
FIG. 17 is a perspective view of the tray holder device of FIG. 16.
Figure 16:
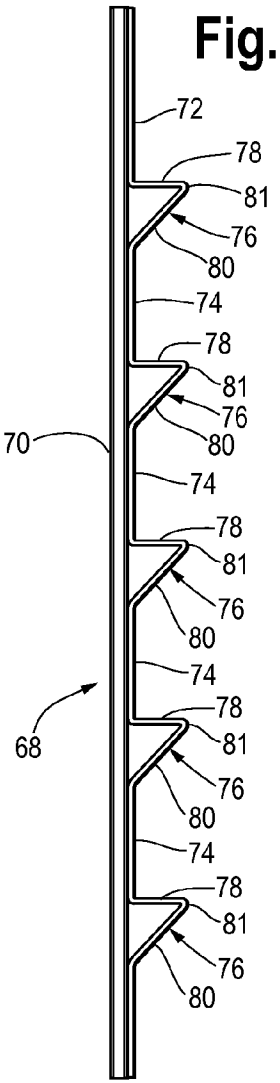
FIG. 16 is a front view of a second embodiment of a tray holder device according to the present invention.

An alternative embodiment of tray holder is shown in FIGS. 16-17. In this embodiment the tray holder is not a single structure that can be folded into a U-shape, but rather a pair of tray holder inserts 68 that are installed on either side of the box 8.

Each tray holder insert 68 comprises a substantially planar backing 70 and a folded member 72 affixed to the backing 70. As in the preferred embodiment, the backing 70 preferably is made of corrugated board and the folded member 72 preferably is made from one or more paper plies. The folded member 72 comprises flat portions 74 interposed between integrally formed, spaced apart ledges 76. The ledges 76 extend from the front edge 75 of the tray holder 70 to the back edge 77. Each ledge 76 comprises a flat, horizontal load supporting panel 78 extending substantially perpendicularly from the corrugated backing 70, and a second panel 80 extending diagonally downward from a distal edge 81 of the load supporting panel 78 to the backing 70.

Figure 18:
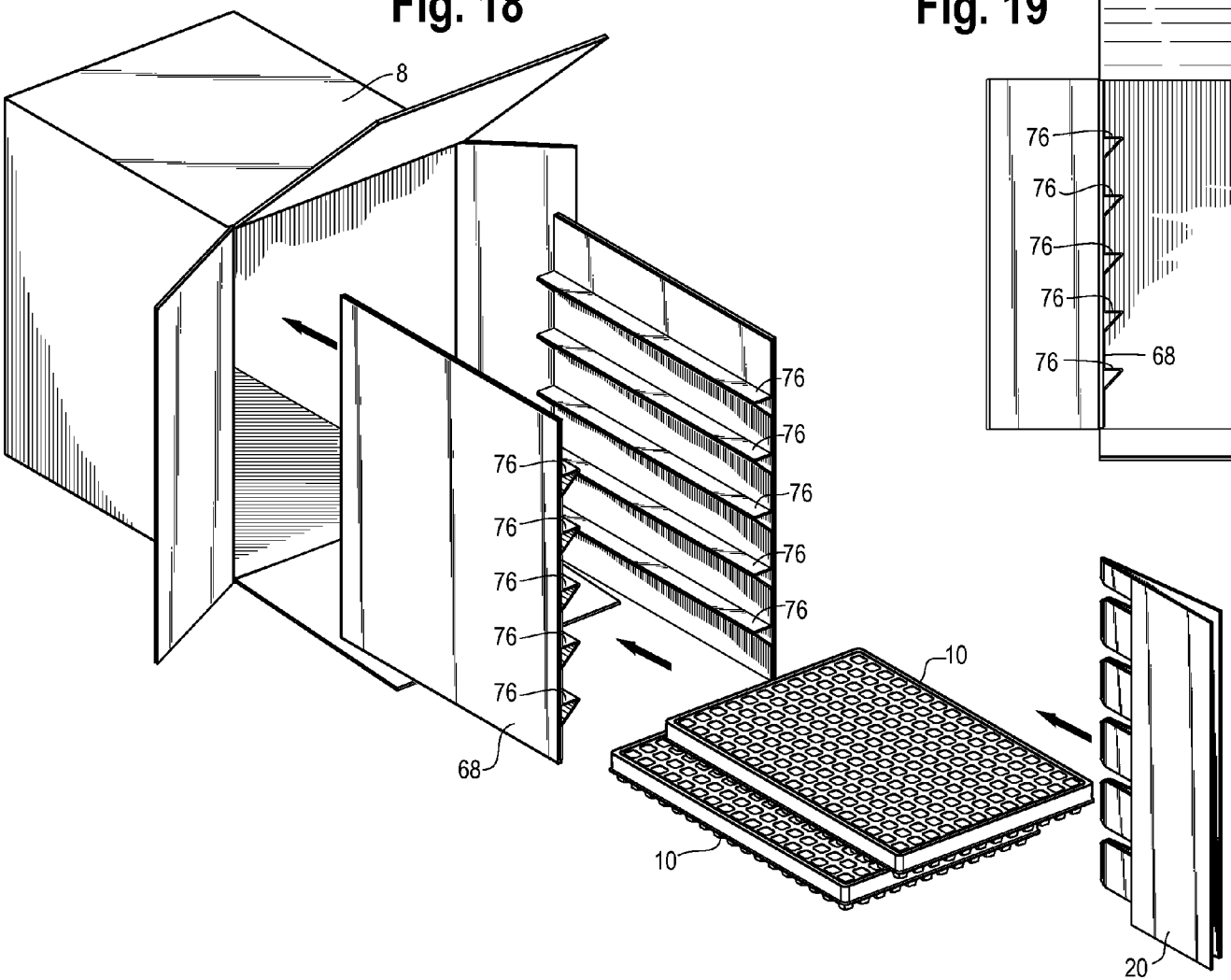
FIG. 18 is an exploded perspective view of a second embodiment of a packaging system for seedling trays according to the present invention, including two tray holders and a tray locking device.

FIG. 18 is an exploded perspective view of the alternative embodiment, including two tray holder inserts 68 and a tray locking device 20. The two tray holder inserts 68 can be wedged inside or adhered to the seedling box 8 against the opposing side walls 60 of the box 8 to provide multiple pairs of opposing ledges 76. The seeding trays 10 can then be placed on and supported by each pair of opposing ledges 76. The rest of the packaging assembly, including the installation of the locking device 20, is the same as in the preferred embodiment.

Figure 19:
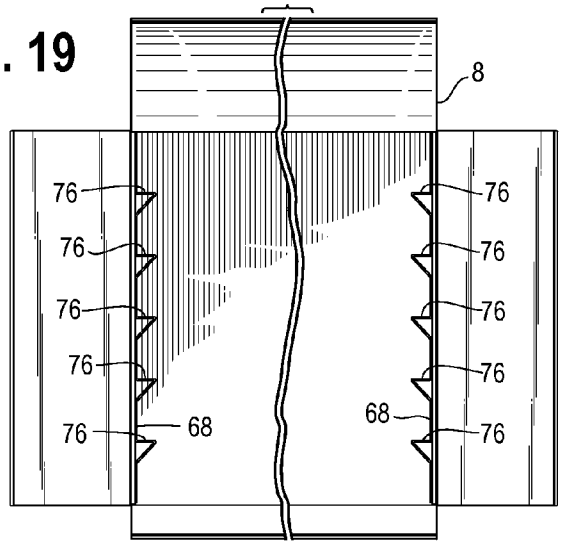
FIG. 19 is a front elevational view of a seedling box shown with the tray holders of FIG. 18 installed.

FIG. 19 is a front elevational view of a packaging system with two tray holder inserts 68 shown installed. As can be readily appreciated, an advantage of this alternative embodiment is that the same pair of tray holder inserts 68 can be used with boxes of any width.

Insulated Seedling Carrier

During cold weather shipping the seedling carrier can be insulated with foam panels. For example, foam panels can be adhered to the three outer-facing surfaces of the U-shaped tray holder 18. More specifically, foam panels can be adhered to the outer facing surface (the surface facing away from the seedling trays) of the bottom panel 22 and the side panels 24 of the U-shaped tray holder 18. Foam panels can also be adhered to the outer facing surfaces of the locking device main panels 46. This arrangement of foam panels will insulate the interior of four of the six sides of the box 8, leaving the top and rear sides without insulation.

To completely surround the seedling trays 12 with foam, the tray holder 18 can be modified by adding a foam backed top flap (not shown) which would be hingedly attached to the top edge 28 of one of the side panels 24, and which could then be folded horizontally to extend to the opposite panel 24 prior to installation, thereby forming a four sided sleeve around the trays 12. A third inserted piece, a foam backed, rectangular shaped, rear panel (not shown), can be placed against the box rear wall (prior to the installation of the modified tray holder) to completely insulate the box on all six interior walls.

Thus there has been described a packaging system 10 for seedling trays 60 which maintains the trays 10 in a stacked, spaced apart vertical arrangement during shipping and handling. The packaging system 10 comprises an outer box 8, a tray holder 18 folded into a U-shape and placed inside the box 8 for holding the trays 10, and a locking device 20 folded and installed so that its locking panels 50 are wedged between the trays 10. The tray holder 18 and locking device 20 can be made from either paper based materials or plastic.

It is to be understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

We claim as our invention:

1. A packaging system for seedling trays, the system comprising:

a box having a bottom and two opposing side walls extending vertically upward from the bottom;

a foldable U-shaped tray holder comprising a bottom panel having parallel side edges and two side panels extending upward from each side edge, each side panel comprising vertically spaced apart ledges, each ledge being horizontally aligned with and in opposition to an opposing ledge when the tray holder is folded into a U-shape, the tray holder disposed inside the box with the side panels adjacent the side walls; and a plurality of trays, each tray resting on a pair of opposing ledges.

2. The packaging system of claim 1 wherein each ledge comprises a flat, load supporting panel extending substantially perpendicular from a corrugated backing and terminating in a distal edge, and a second, diagonal panel extending diagonally downward from the distal edge to the backing.

3. The packaging system of claim 1 further comprising:

a locking device comprising a flat body panel having front and rear edges and multiple, spaced apart locking panels extending from the rear edge, the locking device disposed in the box with the locking panels extending between the trays and the body panel folded along the rear edge so that the body panel is adjacent the trays in facing relationship therewith.

4. The packaging system of claim 1 further comprising:

a locking device comprising two halves hingedly connected to each other along a center fold line, each half comprising a body panel having front and rear edges and multiple, spaced apart locking panels extending from the rear edge, the locking panels of one half being horizontally aligned with and in opposition to the locking panels of the other half, each pair of opposing locking panels being connected along the center fold line to form a hinged locking tab, the locking device disposed in the box with the locking tabs extending between the trays and the body panels folded away from each other along rear edges with each body panel adjacent the trays in facing relationship therewith.

5. The packaging system of claim 4 wherein each tray comprises a substantially flat top surface, a side wall extending downward from the periphery of the top surface and having a vertical thickness, and multiple individual cup-shaped cells extending downward from the top surface, and wherein the distance between each pair of vertically spaced apart locking tabs is substantially the same as the vertical thickness of each tray side wall.

6. The packaging system of claim 4 wherein each tray has a vertical thickness, and wherein the distance between each pair of vertically spaced apart locking tabs is substantially the same as the vertical thickness of each tray.

7. A packaging system for seedling trays, the system comprising:

a box having a bottom and two opposing side walls extending vertically upward from the bottom;

a pair of tray holder inserts, each tray holder insert comprising flat portions interposed between integrally formed, spaced apart ledges, the tray holder inserts disposed against the opposing box side walls so that each ledge of one insert is horizontally aligned with and in opposition to a ledge of the other insert to form a pair of opposing ledges;

a plurality of trays, each tray resting on a pair of opposing ledges; and a locking device comprising two halves hingedly connected to each other along a center fold line, each half comprising a body panel having front and rear edges and multiple, spaced apart locking panels extending from the rear edge, the locking panels of one half being horizontally aligned with and in opposition to the locking panels of the other half, each pair of opposing locking panels being connected along the center fold line to form a hinged locking tab, the locking device disposed in the box with the locking tabs extending between the trays and the body panels folded away from each other along rear edges with each body panel abutting the trays in facing relationship therewith.

8. The packaging system of claim 7 wherein each ledge comprises a flat, horizontal load supporting panel extending substantially perpendicularly from a corrugated backing, and a second panel extending diagonally downward from a distal edge of the load supporting panel to the backing.

9. The packaging system of claim 7 wherein each tray comprises a substantially flat top surface, a side wall extending downward from the periphery of the top surface and having a vertical thickness, and multiple individual cup-shaped cells extending downward from the top surface, and wherein the distance between each pair of vertically spaced apart locking tabs is substantially the same as the vertical thickness of each tray side wall.

* * * * *